US005375370A

United States Patent [19]

Zimmerman

[11] Patent Number: 5,375,370

[45] Date of Patent: Dec. 27, 1994

[54] FLOWER ARRANGEMENT HOLDER

[76] Inventor: Clara H. Zimmerman, 1030 Ave. F, Parkland, Pa. 19047

[21] Appl. No.: 216,459

[22] Filed: Mar. 23, 1994

[51] Int. Cl.[5] ..... A01G 5/00; A47G 7/00

[52] U.S. Cl. ..... 47/41.01; 47/41.13; 248/188

[58] Field of Search ..... 47/41.13, 41.01; 248/188, 188.5

[56] References Cited

U.S. PATENT DOCUMENTS

| | | | |
|---|---|---|---|
| D. 322,768 | 12/1991 | Lillelund et al. . | |
| 781,414 | 1/1905 | Garnsey | 47/41.13 |
| 877,145 | 1/1908 | Waddell | 47/41.13 |
| 903,227 | 11/1908 | Pruden | 47/41.13 |
| 1,474,753 | 11/1923 | Zrebiec | 47/39 |
| 1,989,952 | 2/1935 | Thomas | 47/41.13 |
| 2,296,043 | 9/1942 | McClary | 248/188 |
| 2,486,932 | 11/1949 | Elliott | 47/41.13 |
| 3,103,375 | 9/1963 | McMullin | 248/188.5 |
| 3,201,080 | 8/1965 | Rose | 248/188.5 |
| 3,865,050 | 2/1975 | Cecchetti | 248/188 |
| 3,960,352 | 6/1976 | Plattner et al. | 248/188 |
| 3,962,825 | 6/1976 | O'Connell . | |
| 4,372,630 | 2/1983 | Fuhri | 248/188 |
| 4,803,805 | 2/1989 | Goldberg . | |
| 5,127,184 | 7/1992 | Cosentino . | |
| 5,142,820 | 9/1992 | Aquino . | |

*Primary Examiner*—Ramon S. Britts
*Assistant Examiner*—Joanne C. Downs

[57] ABSTRACT

A plate is provided symmetrically oriented about an axis, having a plurality of annular arrays of openings directed through the plate, with the openings of adjacent annular arrays offset relative to one another to each permit reception of individual flower stems through the guide plate, with the guide plate having support legs removably mounted thereto and permitting positioning of the guide plate within a container for the support of flowers and the like.

1 Claim, 2 Drawing Sheets

FLOWER ARRANGEMENT HOLDER

BACKGROUND OF THE INVENTION

1. Field of the Invention

The field of invention relates to flower arrangement apparatus, and more particularly pertains to a new flower arrangement holder wherein the same is configured to permit ease of positioning arrays of flowers by guidance through a central guide plate which receives the flower stems in a predetermined array.

2. Description of the Prior Art Flower arrangement structure is indicated in the prior art such as exemplified by the U.S. Pat. Nos. 3,962,825; 4,803,805; 5,127,184; and 5,142,820.

The instant invention attempts to overcome deficiencies of the prior art by providing for guide plate structure permitting the ease of presenting desired arrays of flowers in a spaced relationship relative to one another and in this respect, the present invention substantially fulfills this need.

SUMMARY OF THE INVENTION

In view of the disadvantages inherent in the known types of flower holder apparatus now present in the prior art, the present invention provides a flower arrangement holder wherein the same provides a guide plate to receive flower stalks therethrough in a predetermined array relative to one another.

To attain this, the present invention provides a plate symmetrically oriented about an axis, having a plurality of annular arrays of openings directed through the plate, with the openings of adjacent annular arrays offset relative to one another to each permit reception of individual flower stems through the guide plate, with the guide plate having support legs removably mounted thereto and permitting positioning of the guide plate within a container for the support of flowers and the like.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is an object of the present invention to provide a new flower arrangement holder which may be easily and efficiently manufactured and marketed.

It is a further object of the present invention to provide a new flower arrangement holder which is of a durable and reliable construction.

An even further object of the present invention is to provide a new flower arrangement holder which is susceptible of a low cost of manufacture with regard to both materials and labor, and which accordingly is then susceptible of low prices of sale to the consuming public, thereby making such flower arrangement holders economically available to the buying public.

Still yet another object of the present invention is to provide a new flower arrangement holder which provides in the apparatuses and methods of the prior art some of the advantages thereof, while simultaneously overcoming some of the disadvantages normally associated therewith.

Even still yet another object of the present invention is to provide a new flower arrangement holder in which a plate is symmetrically oriented about an axis and has a plurality of annular arrays of openings directed through the plate, with the openings of adjacent annular arrays offset relative to one another to each permit reception of individual flower stems through the guide plate, with the guide plate having support legs removably mounted thereto and permitting positioning of the guide plate within a container for the support of flowers and the like.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
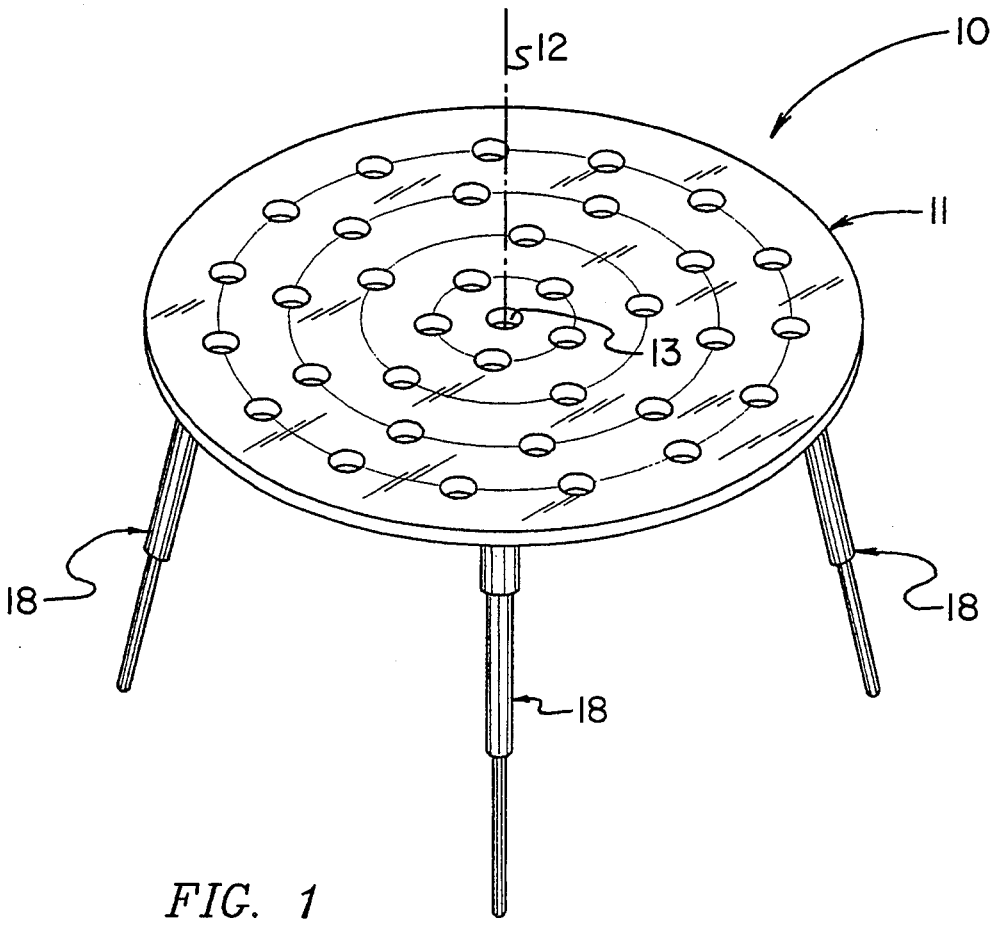
FIG. 1 is an isometric illustration of the invention.
Figure 2:
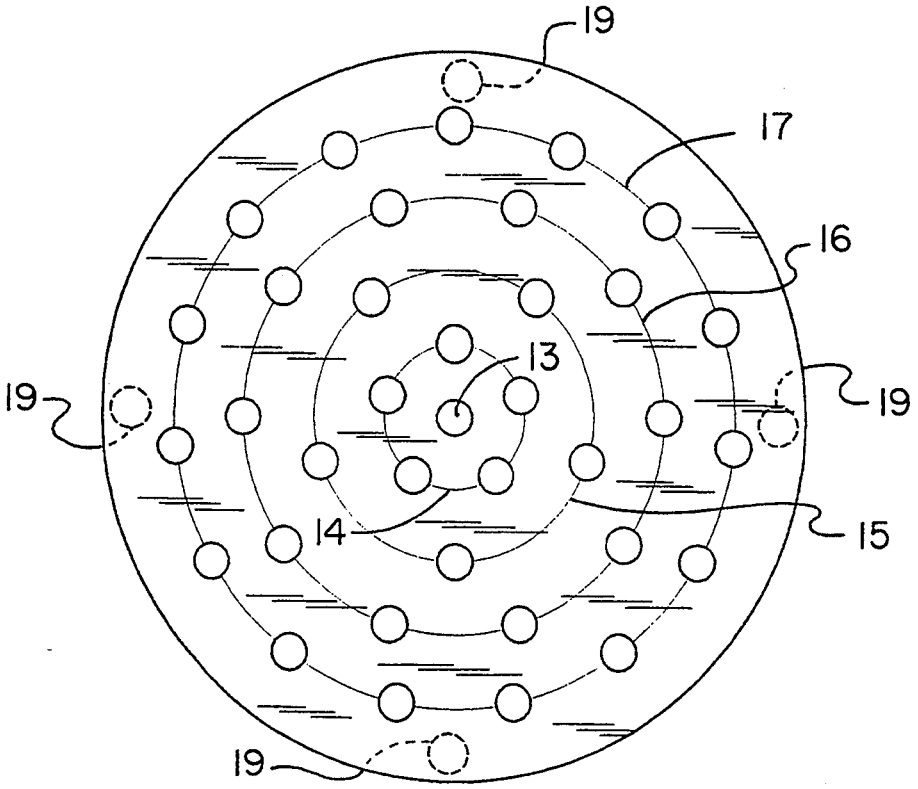
FIG. 2 an orthographic top view of the invention.
Figure 3:
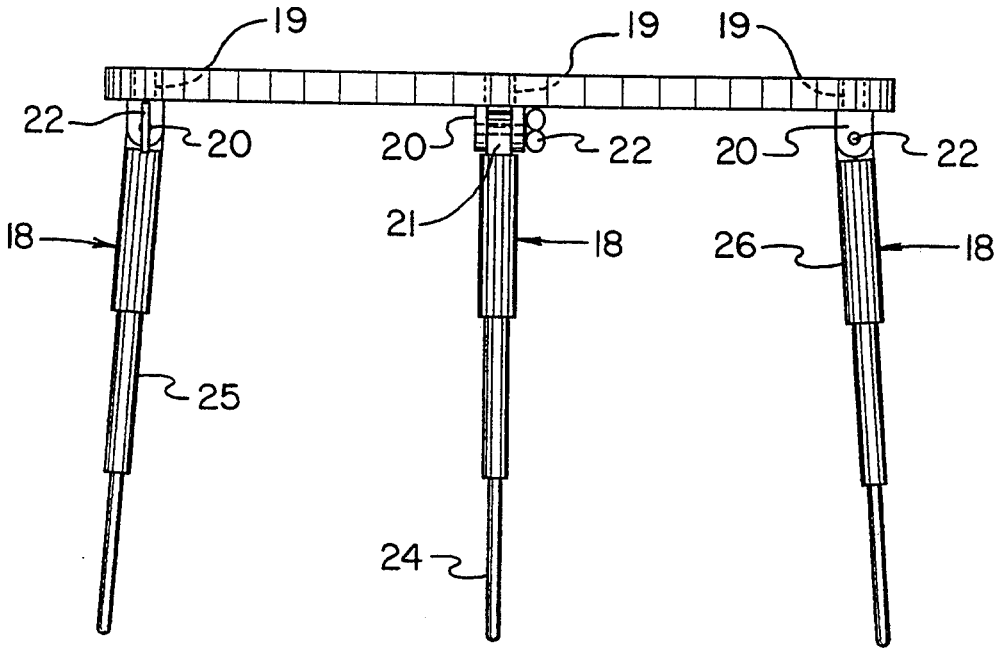
FIG. 3 is an orthographic side view of the invention.

With reference now to the drawings, and in particular to FIGS. 1–4 thereof, a new flower arrangement holder embodying the principles and concepts of the present invention and generally designated by the reference numeral 10 will be described.

More specifically, the flower arrangement holder 10 of the instant invention comprises a rigid guide plate 11 symmetrically oriented about an axis 12 and having a central bore 13, with at least a first, second, third, and fourth annular array of openings 14, 15, 16, and 17 directed concentrically about the central bore 13, with each of the openings of the annular arrays 14–17 offset relative to adjacent openings of adjacent annular arrays to accommodate flower stems therethrough. The rigid guide plate 11 may be positioned within an upper opening of a tapered vase, whereby such taper retains the guide plate spaced from the floor, with the openings 14–17 receiving flower stems therethrough to position the flowers in a consistently organized arrangement.

To accommodate non-tapered vases, telescoping legs 18 may be provided and are removably mounted relative to a bottom surface of the plate 11. To this end, sockets 19 are directed into a bottom surface of the plate 11, with each socket including a bifurcated mount 20 to accommodate a leg stub 21 of each telescoping leg 18.

Figure 4:
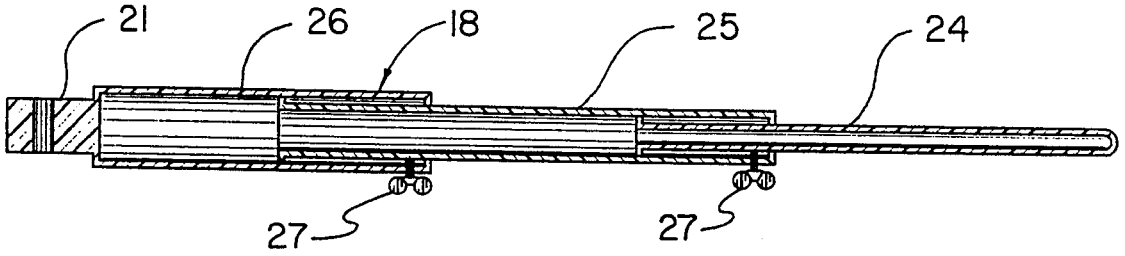
FIG. 4 is an orthographic cross-sectional illustration of an individual support leg structure.

An axle fastener 22 is directed through the bifurcated mount 20 and the leg stub 21 to capture and adjustably sectire the leg stub between the bifucated mount. Each of the telescoping legs 18, as illustrated in FIG. 4, comprises a first member 24 slidably received within a second member 25 which is in turn slidably received within a third member 26 mounted to the leg stub 21. A pair of winged fasteners 27 are directed through the second and third members to secure the position of the first and second members relative to the second and third members, respectively. The telescoping legs 18 provide for positioning of the structure within an unillustrated, non-tapered vase container, whereby the guide plate 11 is supported by the legs and the stems of the flowers rest upon a bottom of the vase. Preferrably, the legs 18 are positioned within the vase to conceal the presence of the legs.

As to the manner of usage and operation of the instant invention, the same should be apparent from the above disclosure, and accordingly no further discussion relative to the manner of usage and operation of the instant invention shall be provided.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so astencompass all such modifications as well as all relationships equivalent to those illustrated in the drawings and described in the specification.

Finally, it will be appreciated that the purpose of the Abstract provided at the beginning of this specification is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the U.S. is as follows:

1. A holder for receiving flower stems of a plurality of flowers and for use with a vase operable to at least partially contain and hold said plurality of flowers, said vase having an upper opening permitting entrance of said flower stems into said vase, said holder comprising:

a rigid, substantially circular guide plate symmetrically oriented about an axis and having a central bore directed orthogonally through the plate, a first annular array of openings directed orthogonally through the plate and arranged concentrically about the central bore, a second annular array of openings directed orthogonally through the plate and arranged concentrically about the first annular array, with each of the openings of the second annular array offset relative to adjacent openings of the first annular array, a third annular array of openings directed orthogonally through the plate and arranged concentrically about the second annular array, with each of the openings of the third annular array offset relative to adjacent openings of the second annular array, and a fourth annular array of openings directed orthogonally through the plate and arranged concentrically about the third annular array, with each of the openings of the fourth annular array offset relative to adjacent openings of the third annular array, the rigid guide plate being positionable within said upper opening of said vase, with the openings being operable to receive the flower stems therethrough to position the flowers in a consistently organized arrangement;

a plurality of telescoping legs mounted to a bottom surface of said plate, whereby said telescoping legs are receivable completely within said vase to provide for positioning of the guide plate within said vase and concealing of said legs, whereby the guide plate is relationship relative to a bottom of said vase by said telescoping legs and said flower stems of said flowers rest upon a bottom of said vase and further wherein each of said legs comprises: a socket mounted to the bottom surface of the plate, with the socket including a bifurcated mount; a leg stub pivotally mounted between the bifurcated mount; an axle fastener directed through the bifurcated mount and the leg stub to capture and adjustably secure the leg stub between the bifurcated mount; a third member mounted to the leg stub; a second member slidably received within the third member; a first member slidably received within the second member; a third member winged fastener threadably directed through the third member for securing a position of the second member relative to the third member; and a second member winged fastener threadably directed through the second member for securing a position of the first member relative to the second member, whereby said plate is adjustably positionable within said vase to various heights relative to said bottom of said vase.

* * * * *